US006116445A

United States Patent [19]

Ikemori et al.

[11] Patent Number: 6,116,445

[45] Date of Patent: Sep. 12, 2000

[54] SEALING CAP FOR CONTAINERS

[75] Inventors: Kenji Ikemori, Kanagawa; Takeharu Ohta, Chiba, both of Japan

[73] Assignee: Kabushikikaisha Fancl, Kanagawa, Japan

[21] Appl. No.: 09/150,346

[22] Filed: Sep. 9, 1998

[30] Foreign Application Priority Data

Sep. 9, 1997 [JP] Japan ..... 9-259384

[51] Int. Cl.[7] ..... B65D 17/30; B65D 39/04; B65D 41/46; B65D 51/22

[52] U.S. Cl. ..... 215/301; 215/254; 215/256; 215/296; 215/320; 220/258; 220/259; 220/267; 220/276; 220/278

[58] Field of Search ..... 220/254, 256, 220/258, 257, 259, 265, 266, 267, 270, 276, 277, 278, 260, 281; 215/301, 235, 250, 253, 254, 256, 257, 295, 296, 320

[56] References Cited

U.S. PATENT DOCUMENTS

| | | | |
|---|---|---|---|
| 3,920,141 | 11/1975 | Bojardi | 215/251 |
| 4,330,067 | 5/1982 | Deussen | 215/251 |
| 5,038,951 | 8/1991 | Rizzardi | 215/256 |
| 5,054,633 | 10/1991 | Reijenga | 215/251 |
| 5,292,025 | 3/1994 | Dubreul | 215/250 |
| 5,758,788 | 6/1998 | Lifshey | 220/278 |

FOREIGN PATENT DOCUMENTS

| | | |
|---|---|---|
| 0647813 | 12/1994 | Japan . |
| 0716625 | 4/1995 | Japan . |
| 8192864 | 7/1996 | Japan . |

*Primary Examiner*—Allan N. Shoap
*Assistant Examiner*—Niki M. Eloshway
*Attorney, Agent, or Firm*—Stevens, Davis, Miller & Mosher, LLP

[57] ABSTRACT

A sealing cap for the mouth of a container facilitates both the sealing of new bottles containing unused contents, and the re-sealing of those bottles already in use so as to preserve their contents. The sealing cap includes an inner cap and an outer cap. The inner cap includes a shielding plate which is fixed on the mouth of a container, and an annular strip which is provided at the lower end of the outer circumferential wall of the inner cap. The outer cap, which is fixed on the inner cap, includes a top lid, and a main cap with a guide tube having a lower-end sharp edge located opposite the shielding plate. By removing the annular strip from the inner cap and pressing down the outer cap, the lower end of the outer cap engages the outer circumference of the mouth of the container, and at the same time, the lower-end sharp edge of the guide tube pierces the shielding plate. The user then opens the top lid of the outer cap to access the contents of the container. Advantages of the sealing cap include the integrity of the seal during preservation of the contents prior to use, the ability to securely re-seal the container once opened, and the ease of operating the outer cap.

6 Claims, 4 Drawing Sheets

SEALING CAP FOR CONTAINERS

BACKGROUND OF THE INVENTION

1. Field of the Invention

This invention relates to a sealing cap that is placed and fixed on the mouth of a container such as bottles made of glass, plastic and other materials, particularly to the cap structure which can be used to seal both new bottles containing unused contents and those bottles already in use so as to preserve their contents.

2. Description of the Related Art

Conventionally, a cosmetic bottle or container 50 containing, e.g., a toilet lotion with no antiseptics added thereto has had its mouth covered with a rubber cap 51, and further with an aluminum cap 52 or a resin cap 53, as shown in FIGS. 11 and 12 to secure tight sealing of the bottle or container, thereby protecting the contents from quality deterioration during its preservation period from the manufacture to sale and to the start of use by consumers. When the user starts their use, he/she removes the caps 53, 52 and 51 in this order, installs another openable cap 54 separately prepared on the mouth of said container 50, as shown in FIG. 13, opens the outer sub-cap 54*a* of this cap 54 for using the contents, and replaces said sub-cap 54 after the use to ensure that the container 50 can be kept sealed.

However, this conventional method has such problems that the user must trouble themselves by removing said caps 51, 52 and 53 and newly installing another openable cap 54 in their place before using the contents. Along with this trouble, tight sealing by the cap of the container 50 can not be assured and there is also the fear of various bacteria entering the container 50 through the above-described cap replacement procedure. Though it is possible to keep the container 50 containing, e.g., toilet lotion, highly sterile by subjecting it to a sterilization treatment, these conditions cannot be maintained after the user begins to use the contents. Another problem is that after the container has been opened for use, the rubber cap 51, aluminum caps 52 and 53 will become waste. Since these waste materials are made of different materials, the need to dispose them separately will be another problem.

In view of these problems, this invention has been made and is intended to provide a sealing cap which will not have to be removed before use, as in conventional sealed containers, but can also be used after the start of use of the contents by consumers and maintain its sealing ability, thereby solving the above-mentioned problems.

According to a first embodiment, this invention concerns the structure of a sealing cap for containers including bottles, etc., wherein a cap-like inner stopper is placed and fixed on said container, said inner stopper having a shielding plate to seal the mouth of said container, that a step is formed at the lower end of the outer wall of said inner cap to form a larger-diameter annular strip, said annular strip being cut at a position and one end thereof protruding outside, that said annular strip is placed on top of the periphery of an annular protrusion provided at the outer circumference of said container mouth, then an outer cap is placed on said inner cap, said outer cap comprising a main cap for sealing said container mouth from above said inner cap, and a top lid for sealing a small hole opened in said main cap, that the bottom end of an outer circumferential wall of said main cap rests on the upper surface of said annular strip of said inner cap, that a guide tube surrounding said small hole of said main cap extends downward within the outer circumferential wall of said main cap, and has a lower end sharp edge, said lower-end sharp edge being located to face the shielding plate of said inner cap, and that when said annular strip of said inner cap is cut off from said inner cap and the outer cap is pressed down, said sharp lower end edge of said tube guide pierces the shield plate of said inner cap while the outer circumferential wall of said outer cap slides down until its bottom end reaches the position just below an annular protrusion formed on the outer wall of said container mouth to be fixed there.

According to a second embodiment, this invention in the sealing cap structure, in addition to the first embodiment, also provides a structure of the lower end part of the outer cap guide tube which is helically formed in such a way that the helical line of said lower end part goes downward from the highest helical position to the lowest helical position that is located almost just below the highest helical position, so that these two helical positions are arranged nearly vertically.

SUMMARY OF THE INVENTION

In one embodiment of the invention can be eliminated the need for the user to remove the sealing cap of cosmetic containers before using the contents, and can maintain their tight sealed conditions even after the user unpacked the containers, thereby protecting the toilet lotion, etc. packed in the containers from quality deterioration throughout the period of use, not to mention the period when the maker stores them at the factory after their manufacture until they are delivered to users. According to this invention, the inner cap is fitted in to seal the container containing cosmetic liquid, etc., and the container is transported or preserved in this state. When a user begins using its contents, he/she will press down the outer cap with his/her fingers, as explained above, to break the inner shield and also fix the outer cap to the inner cap. Then he/she can use the contents by opening the top lid of the outer cap. With this structure, the container sealed conditions can be maintained until the user uses up the contents. If any heat resisting resin is used for the outer and inner caps according to this invention, therefore, further high sterility will be assured throughout the period of use by applying a heat sterilization treatment process to the container together with these caps, after is was filled with the contents. Still another advantage is that the users can easily take out the contents by simply pressing down the outer cap without staining their hand with the contents.

In addition to the advantages according to the first embodiment a second embodiment of this invention permits the shield plate of the inner cap to be broken more widely and more reliably by a lesser amount of manual strength, by means of a sharp edge provided at the lower end of said guide tube.

DETAILED DESCRIPTION OF THE PREFERRED EMBODIMENTS

An explanation will be given below about an embodiment of this invention in reference to the accompanying drawings.

Figure 2:
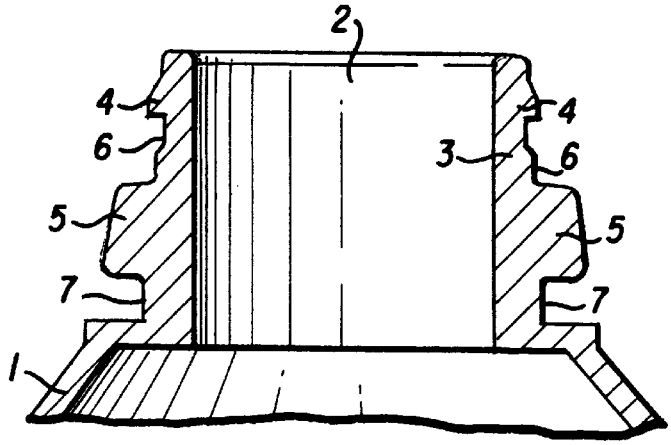
FIG. 2 shows a vertical section of the container mouth used in said embodiment.

The mouth 2 of container 1 according to this invention, as shown in FIG. 2, has an annular protrusion 4 at the uppermost position, and another annular protrusion 5 spaced a distance below said protrusion 4, on the outer surface of its external wall 3. These annular protrusions 4 and 5 have an upper annular recess 6 between them, and a lower annular recess 7 is formed just below said annular protrusion 5.

Figure 1:
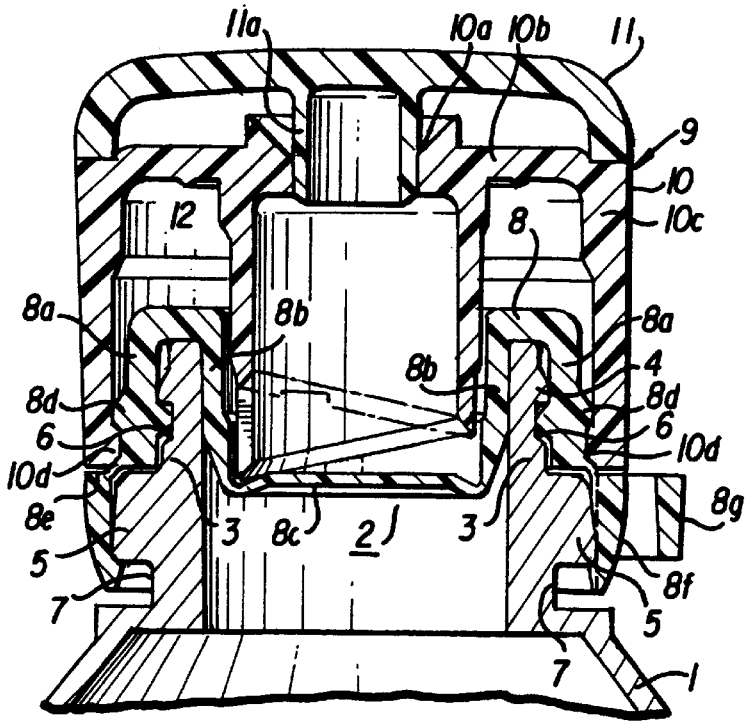
FIG. 1 shows a vertical section of an embodiment of this invention.
Figure 3:
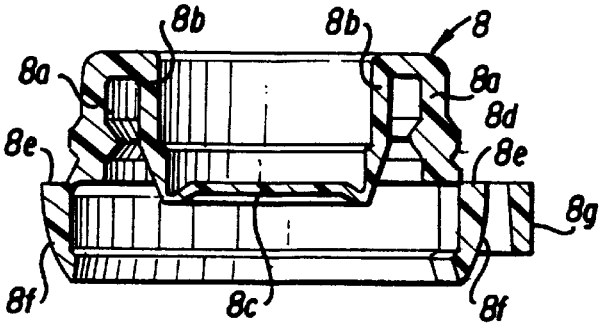
FIG. 3 shows a vertical section of the inner cap used in said embodiment.
Figure 4:
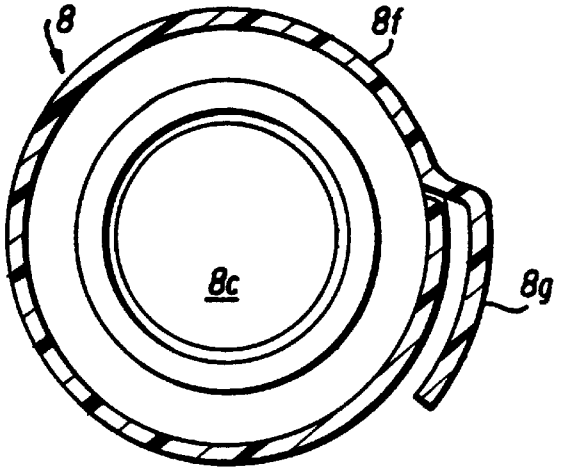
FIG. 4 shows a bottom cross section of the inner cap used in said embodiment.

The mouth 2 of container 1 is covered with an inner cap 8 as shown in FIG. 1. This inner cap 8, as shown in FIGS. 3 and 4 has an outer circumferential wall 8*a* to cover mouth 2's external wall 3, an inner circumferential wall 8*b* which extends inwardly from the top of outer circumferential wall 8*a* to the inside of outer circumferential wall 8*a* and then goes down in the form of a reversed U-shape, and a shielding plate 8*c* which laterally extends across the lower end of inner circumferential wall 8*b* to seal the mouth 2 of container 1. This shielding plate 8*c* has a thin edge with which it contacts inner circumferential wall 8*b*. Further, outer circumferential wall 8*a* downwardly connects to an annular protrusion 8*d* protruding both inside and outside, at the lower end of which is formed a step 8*e* to provide a larger-diameter annular strip 8*f* which is cut at a position to extend its one end 8*g* outwardly.

When this inner cap 8 is fitted onto the mouth 2 of container 1, as shown in FIG. 1, its outer circumferential wall 8*a* fits on the outer wall 3 of the container mouth 2, and the annular strip 8*f* located below outer circumferential wall 8*a* is placed on the outer surface of annular protrusion 5 provided at the outer wall of mouth 2. On the other hand, the inner circumferential wall 8*b* of inner cap 8 goes down along the inner surface of the outer wall 3 of mouth 2, so that the shielding plate 8*c* can be located within the lower area of the mouth 2 to seal its cavity.

Under these conditions, the annular protrusion 8*d* protruding inwardly below the outer circumferential wall 8*a* of inner cap 8 engages with the upper annular recess 6 on the outer wall 3 of mouth 2 to ensure that inner cap 8 can engage with and be fixed on, the mouth 2.

Figure 5:
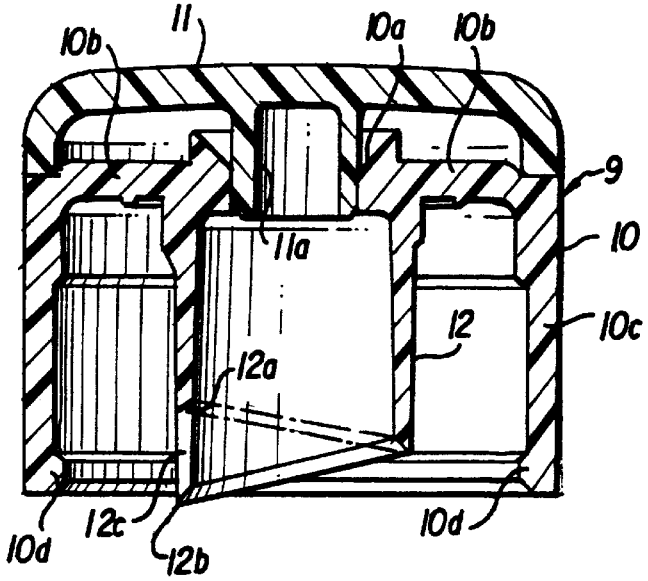
FIG. 5 shows a vertical section of the outer cap used in said embodiment.
Figure 6:
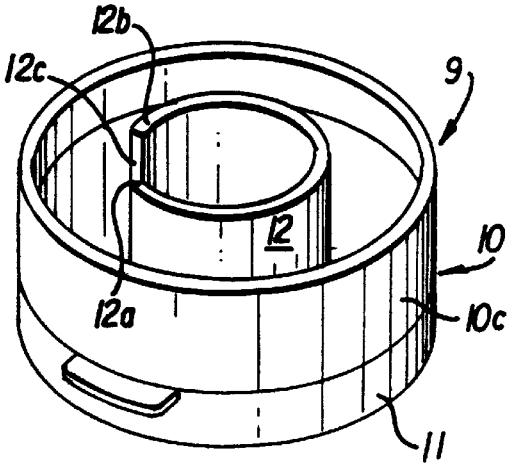
FIG. 6 shows a bottom perspective view of the outer cap used in said embodiment.

Located above inner cap 8 is the outer cap 9 which covers and is fixed on inner cap 8 as shown in FIG. 1. This outer cap 9, as shown in FIGS. 5 and 6, comprises the main cap 10 which seals the mouth 2 of container 1 from above inner cap 8 and a top lid 11 which seals a small hole 10*a* of main cap 10. Said main cap 10 has an external circumferential wall 10*c* hanging down vertically from the peripheral end of a circular top plate 10*b* having small hole 10*a*. This external circumferential wall 10*c* has an inner annular protrusion 10*d* on the inner surface of its lower end. Furthermore, top lid 11 has at its center a protrusion 11*a* fitted in small hole 10*a*, and is openably installed on the main cap by a hinge 11*b* (see FIGS. 7 and 8) attached to an upper end of external circumferential wall 10*c* of main cap 10. A guide tube 12 (FIG. 5) extends down around small hole 10*a* from the bottom surface of top plate 10*b*. The lower end edge portion of this guide tube 12 is helically formed in such a way that the helical line of the lower end part goes helically downward from the highest helical position 12*a* to the lowest helical position 12*b* that is located almost just below the highest helical position 12*a*, so that these two positions 12*a* and 12*b* are arranged along a nearly vertical edge line 12*c*. At the bottom end of guide tube 12, a sharp edge is formed by lowest helical part 12*b* and the nearly vertical edge line 12*c*.

Figure 7:
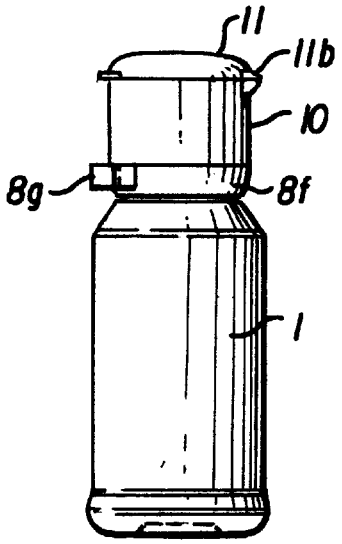
FIG. 7 shows an elevation of the external configuration of the container used in said embodiment.
Figure 8:
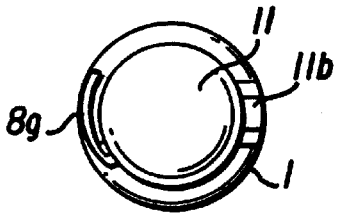
FIG. 8 shows a plan of the external configuration of the container used in said embodiment.

When this outer cap 9 is placed on inner cap 8 as shown in FIG. 1, the bottom end of external circumferential wall 10*c* of main cap 10 rests on the step 8*e*, i.e., the upper surface of annular strip 8*f* of inner cap 8 so that the external circumferential wall 10*c* of main cap 10 can be located on the annular strip 8*f* of inner cap 8. Under these conditions, the lower end edge of guide tube 12 is facing the shielding plate 8*c* of inner cap 8. Particularly, the bottom end 12*b* of guide tube 12 has drawn near the shielding plate 8*c*. At that time, further, the inner annular protrusion 10*d* of main cap 10 of outer cap 9 has fitted in the annular recess formed on the annular protrusion 8*d* of the external wall 8*a* of the inner cap 8, so that the outer cap 9 cannot easily come off from the inner cap 8. FIGS. 7 and 8 present an elevation and plan of the appearance of the inner cap 8 and outer cap 9 mounted on the container 1 with the above-mentioned structure, As shown there, the annular strip 8*f* of inner cap 8 is exposed above the container 1 and below the outer cap 9.

Also, one end 8*g* of annular strip 8*f* is seen to protrude out.

Figure 9:
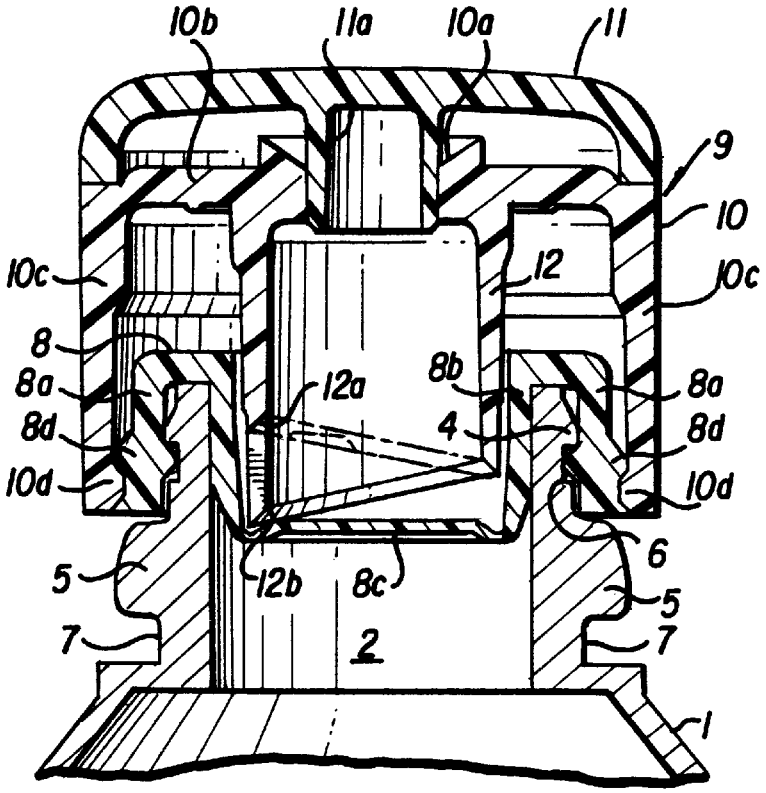
FIG. 9 shows a vertical section illustrating the state of said embodiment after the annular strip of the inner cap has been peeled off.
Figure 10:
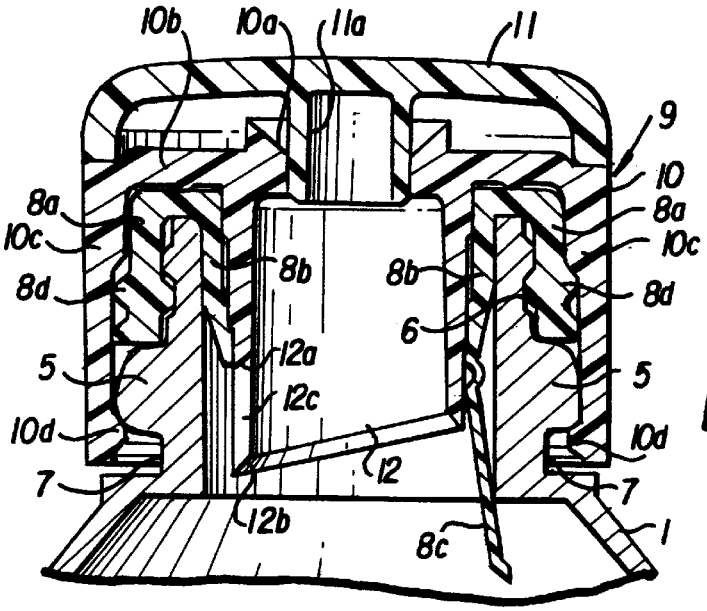
FIG. 10 shows a vertical section illustrating the state of said embodiment after the shield plate of the inner cap has been broken.
Figure 11:
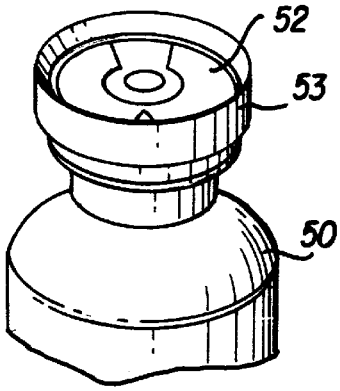
FIG. 11 (PRIOR ART)
FIG. 11 shows a partial perspective view of a conventional sealing lid.
Figure 12:
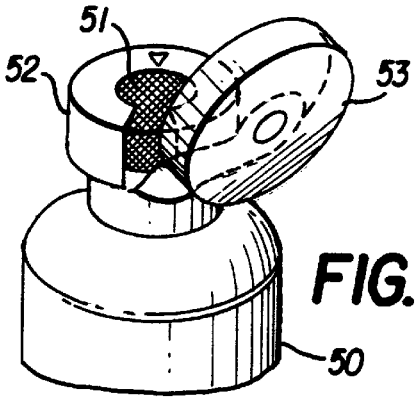
FIG. 12 (PRIOR ART)
FIG. 12 shows a partial perspective view of a conventional sealing lid where the resin and aluminum caps have been removed to expose the rubber cap.
Figure 13:
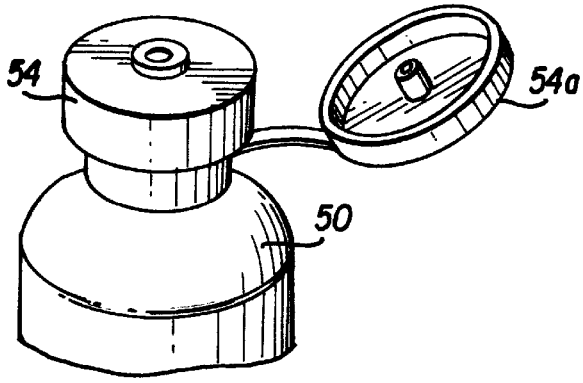
FIG. 13 (PRIOR ART)
FIG. 13 shows a partial perspective view of the container where conventional sealing lids have been replaced with an openable cap.

A toilet lotion, for instance, is poured into the container 1, in an embodiment of this invention, and the inner cap 8 is placed and fixed on its mouth 2 to seal the container, and further the outer cap 9 is placed on the inner cap 8 and fixed there. The container 1 is preserved under this condition until it is delivered to the user. For the user to use this toilet lotion he/she pulls the end 8*g* of annular strip 8*f* to peel it off from the lower end of outer cicumferential wall 8*a* of the inner cap 8 as shown in FIG. 9. Then, when he/she presses the outer cap 9 from above with his/her finger as shown in FIG. 10, the outer cap 9 lowers, while the outer wall 10*c* of main cap 10 slides down over the outer wall 8*a* of inner cap 8 and the annular protrusion 5 of the mouth 2 of container 1. The outer cap 9 stops lowering when the bottom surface of the top plate 10*b* of main cap 10 hits on the upper surface of the outer and inner walls 8*a* and 8*b* of inner cap 8.

When outer cap 9 lowers, the guide tube 12 of main cap 10 also lowers through the inside of inner circumferential wall 8*b* of inner cap 8. As the guide tube 12 moves lower, its sharp bottom-end edge formed by the lower helical part 12*b* and the vertical edge line 12*c* begins piercing the peripheral thin area of the shield plate 8*c* of inner cap 8 and gradually widens the cut according to its inclined lower-end configuration. At last, as shown in FIG. 10, the shield plate 8*c* is completely cut off from the inner circumferential wall 8*b* except for part of its periphery, and hangs down from inner wall 8*b*. At that time, the inner protrusion 10*d* on the outer circumferential wall 10*c* of main cap 10 of the outer cap 9 is fitted with the lower annular recess 7 located below the annular protrusion 5 on the outer wall 3 of container 1 to fix the outer cap 9.

By this, the inner cap 8 fitted within the mouth 2 of container 1 opens at the bottom. For taking out the toilet lotion in the container 1, the top lid 11 of outer cap 9 is opened around the hinge 11*b*. This opens the small hole 10*a* in the top plate 10*b* of main cap 10, making it possible for the toilet lotion to pour out through the guide tube 12 and small hole 10*a* when the container 1 is tilted. When the top lid 11 is replaced on the main cap 10, its protrusion 11*a* will fit again in the small hole 10*a* of main cap 10 to seal the container 1.

Incidentally, in the above-explained embodiment of this invention, it is arranged that the bottom-end helical part of the guide tube 12 of main cap 10 in the outer cap 9 is formed in such a way that the helical line of the lower end part goes downward from the highest helical position 12*a* to the lowest helical position 12*b* that is located almost just below highest helical position 12*a*, so that these two positions 12*a* and 12*b* are arranged along a nearly vertical edge line 12*c*. However, this invention is not limited to this configuration, and the bottom portion of guide tube 12 may simply have a sharp edge or may be cut obliquely to be given a sharp bottom edge. Furthermore, when the inner cap 8 is placed over the mouth 2 of container 1, its shield plate 8*c* need not always be located at a lower position within the mouth 2 and also the peripheral edge of shield plate 8*c* need not always be made thin. Even if the peripheral edge is not thin, the shield plate 8*c* of inner cap 8 can easily break if the outer cap is pressed down vigorously with the fingers of the user. In the above embodiment, the shield plate 8*c* of inner cap 8 is cut off with the bottom end of guide tube 12 and the cut shield plate hangs down from the lower end of the inner circumferential wall 8*b*, but this invention is not limited to this invention if the shield plate 8*c* is broken only partially with the bottom edge of guide plate 12, it will be enough for the contents to flow out of the container and is within the scope of the claimed invention.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

What is claimed is:

1. A sealing cap for containers, the sealing cap comprising an inner cap to be placed and fixed on an opening in said container forming a mouth, said inner cap comprising (i) a shielding plate to seal the mouth of said container, and (ii) a step formed at the lower end of an outer wall of said inner cap to form a larger-diameter annular strip, said annular strip being cut at a position and one end thereof protruding radially outward of outer wall, and said annular strip being adapted to be positioned on top of the periphery of an annular protrusion provided at an outer circumference of said container mouth;

an outer cap positioned on said inner cap, said outer cap comprising (i) a main cap for sealing container mouth from above said inner cap, and (ii) a top lid for sealing a small hole opened in said main cap, a bottom end of an outer circumferential wall of said main cap resting on the upper surface of annular strip of said inner cap, a guide tube surrounding said small hole of said main cap extending downward within the outer circumferential wall of said main cap, having a lower-end sharp edge, said lower-end sharp edge being located to face the shielding plate of said inner cap, wherein when said annular strip of said inner cap is removed from said inner cap and the outer cap is pressed down, said lower-end sharp edge of said tube guide pierces the shielding plate of said inner cap while the outer circumferential wall of said outer cap slides down until its bottom end reaches a position just below said annular protrusion so as to be fixed in position below said protrusion.

2. The sealing cap for containers according to claim 1, wherein a lower end part of said outer cap guide tube is helically formed in such a way that the helical line of said lower end part goes downward from a highest helical position to a lowest helical position that is located almost just below highest helical position so that these two helical positions are arranged nearly vertically.

3. The sealing cap for containers, according to claim 1, wherein the lower-end sharp edge of said tube guide is cut obliquely to form said sharp edge.

4. The sealing cap of claim 1, wherein the shielding plate of said inner cap is thinner at its peripheral edge than the remainder of the shielding plate.

5. The sealing cap of claim 1, wherein the pierced sheilding plate hangs down from the lower end of an inner circumferential wall of the inner cap.

6. A sealing cap for a bottle, the sealing cap comprising an inner cap to be placed and fixed on an opening in said bottle forming a mouth, said inner cap comprising (i) a shielding plate to seal the mouth of said bottle, and (ii) a step formed at the lower end of an outer wall of said inner cap to form a larger diameter annular strip, said annular strip being cut at a position and one end thereof protruding radially outward of said outer wall, and said annular strip being adapted to be positioned on top of the periphery of an annular protrusion provided at an outer circumference of said bottle mouth;

an outer cap position on said inner cap, said outer cap comprising (i) a main cap for sealing said bottle mouth from above said inner cap, and (ii) a top lid for sealing a small hole opened in said main cap, a bottom end of an outer circumferential wall of said main cap resting on the upper surface of annular strip of said inner cap, a guide tube surrounding said small hole of said main cap extending downward within the outer circumferential wall of said main cap, having a lower-end sharp edge, said lower-end sharp edge being located to face the shielding plate of said inner cap, wherein when said annular strip of said inner cap is removed from said inner cap and the outer cap is pressed down, said lower-end sharp edge of said guide tube pierces the shielding plate of said inner cap while the outer circumferential wall of said outer cap slides down until its bottom end reaches a position just below said annular protrusion so as to be fixed in position below said protrusion.

* * * * *